US007451786B2

(12) United States Patent
Debaes

(10) Patent No.: US 7,451,786 B2
(45) Date of Patent: Nov. 18, 2008

(54) WEAVING MACHINE FOR WEAVING PILE FABRICS, AND SET OF AT LEAST TWO SPACERS PROVIDED TO BE MOUNTED NEXT TO ONE ANOTHER IN A WEAVING MACHINE FOR WEAVING PILE FABRICS

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/980,897

(22) Filed: Oct. 31, 2007

(65) Prior Publication Data

US 2008/0115852 A1 May 22, 2008

(30) Foreign Application Priority Data

Nov. 17, 2006 (BE) ..... 2006/0558

(51) Int. Cl.
*D03D 39/16* (2006.01)
*D03D 39/18* (2006.01)
*D03D 39/00* (2006.01)

(52) U.S. Cl. ..... 139/21; 139/37; 139/38; 139/40; 139/41

(58) Field of Classification Search ..... 139/21, 139/37, 38, 40, 41
See application file for complete search history.

(56) References Cited

U.S. PATENT DOCUMENTS

| | | | | | |
|---|---|---|---|---|---|
| 1,691,184 | A * | 11/1928 | Howard | 139/37 |
| 1,741,916 | A * | 12/1929 | Britton | 139/38 |
| 2,638,934 | A * | 5/1953 | Parker | 139/38 |
| 2,710,028 | A * | 6/1955 | White | 139/38 |
| 2,713,356 | A * | 7/1955 | Hoeselbarth | 139/41 |
| 2,714,397 | A * | 8/1955 | Morgan | 139/21 |
| 2,731,985 | A * | 1/1956 | Hoeselbarth | 139/39 |
| 2,750,964 | A * | 6/1956 | Hoeselbarth | 139/39 |
| 2,879,730 | A * | 3/1959 | Smith | 112/80.5 |
| 2,896,670 | A * | 7/1959 | Rice | 139/38 |
| 3,289,706 | A * | 12/1966 | Valentine | 139/21 |
| 3,394,739 | A * | 7/1968 | Crenshaw et al. | 139/21 |
| 5,154,208 | A * | 10/1992 | Derudder | 139/37 |
| 5,615,712 | A * | 4/1997 | Derudder et al. | 139/21 |
| 6,176,270 | B1 | 1/2001 | Mettler | |
| 6,186,189 | B1 * | 2/2001 | Gheysen | 139/392 |
| 6,273,148 | B1 * | 8/2001 | Debaes et al. | 139/402 |

(Continued)

FOREIGN PATENT DOCUMENTS

| | | |
|---|---|---|
| EP | 0536551 | 4/1993 |

(Continued)

*Primary Examiner*—Bobby H Muromoto, Jr.
(74) *Attorney, Agent, or Firm*—James Creighton Wray; Clifford D. Hyra

(57) ABSTRACT

The invention relates to a weaving machine for weaving pile fabrics, and a set (100) of at least two spacers (1-4, 11, 12, 21, 22, 31, 32, 41 and 42), wherein the spacers (1-4, 11, 12, 21, 22, 31, 32, 41 and 42) are provided and arranged in the weaving machine in such a manner that the pile warp yarns (18, 18') have more space during their movement in the shed-forming zone towards the fabric line in the warp direction at their entry point in the array of lancets, so that they are hindered to a lesser degree by this array of lancets.

14 Claims, 4 Drawing Sheets

U.S. PATENT DOCUMENTS

| | | | | |
|---|---|---|---|---|
| 6,817,383 | B2 * | 11/2004 | Debaes et al. | 139/21 |
| 6,837,274 | B2 * | 1/2005 | Debaes et al. | 139/21 |
| 7,111,647 | B2 * | 9/2006 | Debaes | 139/21 |
| 7,117,897 | B2 * | 10/2006 | Debaes | 139/21 |
| 7,134,401 | B2 * | 11/2006 | Debaes et al. | 116/21 |
| 7,240,698 | B2 * | 7/2007 | Debaes | 139/37 |
| 2003/0226613 | A1 * | 12/2003 | Debaes et al. | 139/408 |
| 2004/0221910 | A1 * | 11/2004 | Debaes | 139/11 |
| 2004/0221915 | A1 * | 11/2004 | Debaes et al. | 139/409 |
| 2005/0109416 | A1 * | 5/2005 | Debaes et al. | 139/37 |
| 2005/0166989 | A1 * | 8/2005 | Debaes et al. | 139/116.2 |
| 2005/0183787 | A1 * | 8/2005 | Debaes | 139/11 |
| 2006/0118195 | A1 * | 6/2006 | Debaes | 139/11 |
| 2007/0006932 | A1 * | 1/2007 | Mertens et al. | 139/37 |

FOREIGN PATENT DOCUMENTS

| | | |
|---|---|---|
| EP | 1347087 | 9/2003 |
| EP | 1375715 | 1/2004 |
| EP | 1524345 | 4/2005 |
| EP | 1568809 | 8/2005 |
| JP | 53/147859 | 12/1978 |

* cited by examiner

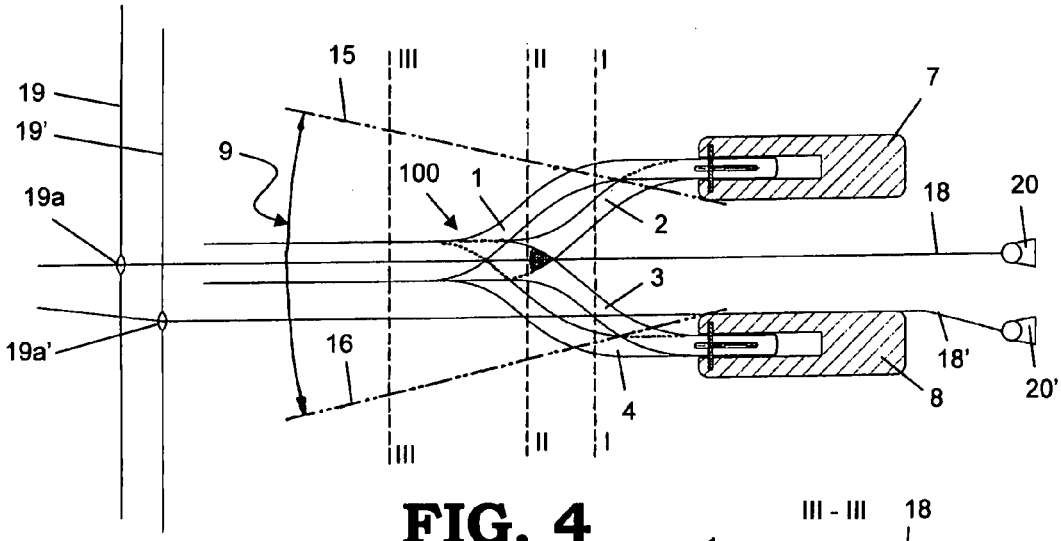
FIG. 4
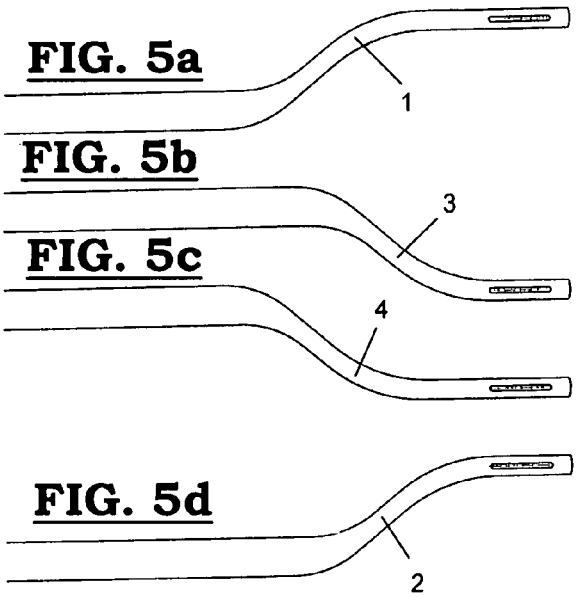
FIG. 5a
FIG. 5b
FIG. 5c
FIG. 5d
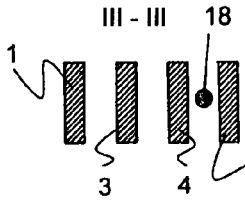
FIG. 6c
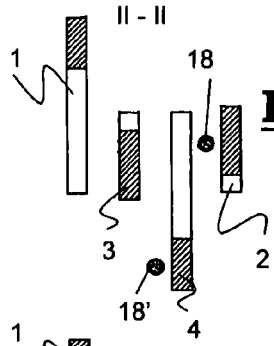
FIG. 6b
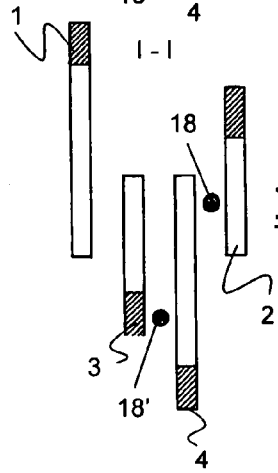
FIG. 6a

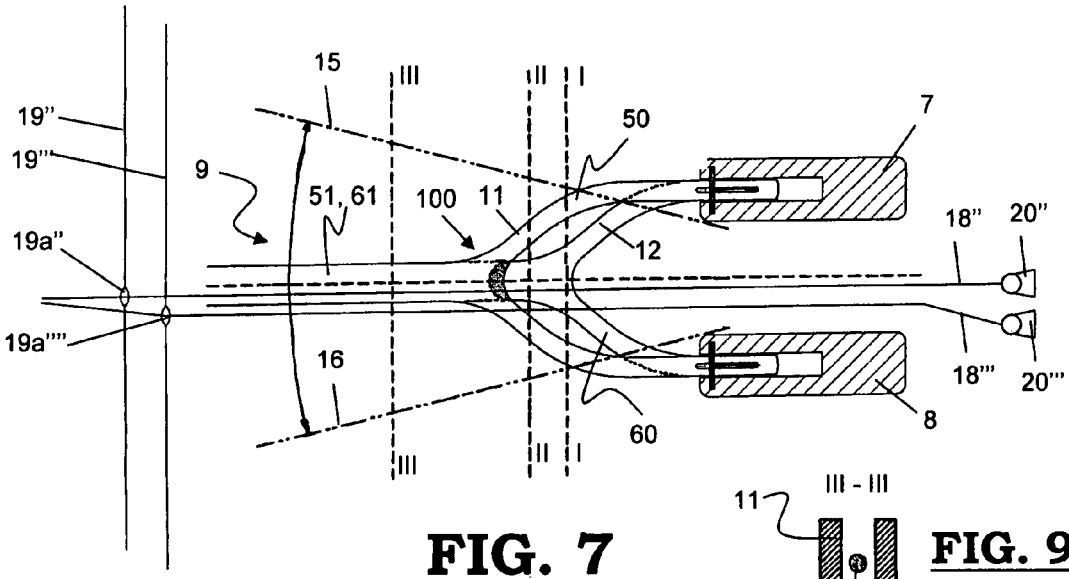
FIG. 7
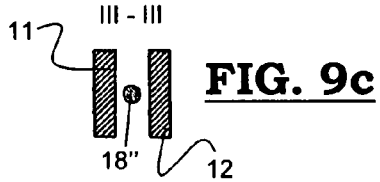
FIG. 9c
FIG. 8a
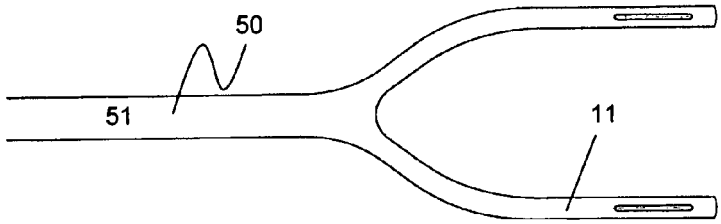
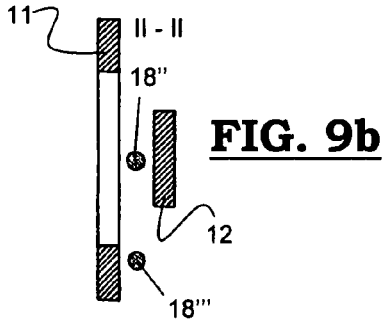
FIG. 9b
FIG. 8b
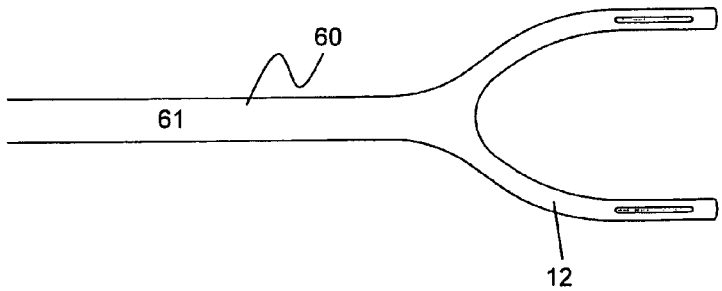
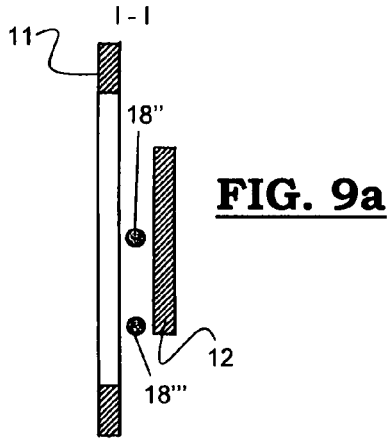
FIG. 9a

WEAVING MACHINE FOR WEAVING PILE FABRICS, AND SET OF AT LEAST TWO SPACERS PROVIDED TO BE MOUNTED NEXT TO ONE ANOTHER IN A WEAVING MACHINE FOR WEAVING PILE FABRICS

This application claims the benefit of Belgian Application No. 2006/0558 filed Nov. 17, 2006, which is hereby incorporated by reference in its entirety.

The invention relates to a weaving machine for weaving pile fabrics, consisting of weft yarns, ground warp yarns and pile warp yarns, comprising

- a bottom and/or top cutting bar which is provided in order to guide at least one pile fabric;
- at least one set of two spacers extending next to one another which extend between the pile warp yarns and which are provided in order to either achieve a uniform pile height between two formed pile fabrics, or to determine the pile loop height in one or more pile fabrics which comprise looped pile, wherein these two spacers extending next to one another, at their ends near the one or more cutting bars, have projections which coincide on projection in the weft direction onto a plane at right angles to the weft direction;
- a yarn stock of pile warp yarns;
- one or more shed-forming devices which drive healds through which ground and/or pile warp yarns extend in order to position these warp yarns with regard to the weft yarns;
- a supply zone of pile warp yarns which extends between said yarn stock and said healds;
- at least two holders to clamp the spacers into, and which are arranged one above the other outside said supply zone;
- a shed-forming zone within which the pile warp yarns can move, and which is delimited by said holders of the spacers and said shed-forming devices.

Furthermore, the invention relates to a set of at least two spacers provided to be mounted next to one another in a weaving machine for weaving pile fabrics, consisting of weft yarns, ground warp yarns and pile warp yarns, the weaving machine comprising

- a bottom and/or top cutting bar which is provided in order to guide at least one pile fabric;
- a yarn stock of pile warp yarns;
- one or more shed-forming devices which drive healds through which ground and/or pile warp yarns extend in order to position these warp yarns with regard to the weft yarns;
- a supply zone of pile warp yarns which extends between said yarn stock and said healds;
- a shed-forming zone within which the pile warp yarns can move, and which is delimited by said holders of the spacers and said shed-forming devices;

and wherein the spacers are provided either to achieve a uniform pile height between two formed pile fabrics, or to determine the pile loop height in one or more pile fabrics which comprise looped pile, and are provided in order to be clamped into at least two holders which are arranged one above the other outside said supply zone.

EP 1 568 809 describes how lancets are used as spacers in a face-to-face weaving machine for weaving pile fabrics in order to keep the top and bottom fabric at the desired distance apart, and maintain the pile height or define the loop height, with each lancet being taken up both in a top and in a bottom spacer holder. This ensures both a stable positioning of the lancet and a good supply of the pile warp yarns in the shed-forming zone. By means of such a device, the height over which the warp yarns have to move is limited during shed formation, as a result of which the overall device can be made more compact and the load on the pile warp yarns in the harness of the weaving machine is reduced.

The lancets arranged next to one another in this case all have the same shape. This means that the zones of the lancets, which the yarn sections of the individual warp yarns which occupy the same shed position contact first, are situated at the same distance from the fabric line according to the warp direction. Mainly with weaving applications for high-density fabrics or fabrics with thick pile warp yarns, the pile warp yarn mass which is situated at the same distance with respect to the fabric line in the warp direction may be significant compared to the space between two lancets. This is particularly disadvantageous when several pile warp yarns which are next to one another have a knot at substantially the same position in the warp direction, and is all the more disadvantageous if these knots occur in pile warp yarns which are between two adjacent lancets and occupy the same position in the shed formation.

During their movement towards the fabric line, these various yarns are pulled between the lancets which are next to one another. Therefore, we refer to the prior art FIGS. 1, 2*a*, 2*b*, 3*a*, 3*b* and 3*c*, as described below in more detail in the detailed description. The pile warp yarns with their knots move from a zone where they do not contact the lancets (zone C, as illustrated in the prior art FIG. 3*c*) to a zone where they contact both neighbouring lancets simultaneously (pile warp yarn 18, 18' in zone B on prior art FIG. 3*b*) as the two lancets have the same shape at the position they are token up in the double lancet holder (see prior art FIG. 2). In EP 1 568 809, this zone at the position is described as the third zone of the lancet holders. If, for example during shed formation, a significant number of pile warp yarns occupy the same position in the shed formation for a considerable number of machine cycles, these yarns do not cross one another, but will, after having passed between both lancet holders, run on together through the "funnels" formed by the third zones of lancets which are next to one another. This passage which is narrowed for the pile warp yarns results in additional load and friction for the pile warp yarns which may lead to damage or rupture of these warp yarns. The friction also results in greater wear of the lancet holders, which in turn leads to sharper edges which in turn leads to yet more damage to the pile warp yarns.

It should be noted that the term "contact" should be interpreted as follows: the pile warp yarns which are under tension are kept in their position in the warp direction by the dents of the weaving reed and by a run-in lattice between the weaving rack and the shed-forming zone during their movement through the two lancet holders which are next to one another and between which they extend. Theoretically, these pile warp yarns can move through the shed without contacting these elements. However, in practice, these pile warp yarns contact these elements in an unpredictable way and at unpredictable points in time during their travel in the warp direction, either on their left-hand side or on their right-hand side. When there is a knot in the pile warp yarn, the risk of such a contact increases. Such contact, particularly in the case of the first contact in the longitudinal direction, resembles a collision with a great impact and these hitches may result in yarn rupture and wear of the spacers.

EP 1 524 345 describes how lancets which are next to one another, in their central section in the longitudinal direction, are arranged at different levels in order to give the pile warp yarn mass and any knots in the pile warp yarns more space when pile warp yarns cross and to prevent the pile warp yarns from sticking together. This method only offers a solution for pile warp yarns which move up and down and not for the problem of knots in pile warp yarns which during their movement in the longitudinal direction collide with the individual lancets at their entry point into the array of lancets. This problem with warp yarns during their movement in the longitudinal direction (in the warp direction) occurs both if the lancets are taken up in a single holder of the lancets in the centre of the shed, as is the case in EP 1 524 345, and if the lancets are taken up in a single holder outside the centre of the shed. FIG. 3 in EP 1 568 809 illustrates and describes the embodiment wherein lancets are alternately taken up in a lancet holder below the centre of the shed and in a lancet holder above the centre of the shed. In the embodiment as illustrated in FIG. 3, a solution may already have been found to limit the impact of the collision between incoming pile warp yarns, which are outside the centre of the shed, and lancets. Upon first contact with the array of lancets, these pile warp yarns are never pulled through a funnel comprising two lancets which are next to one another. The funnel is formed by two lancets which have the same profile in the warp direction, between which a lancet which has a different profile in the warp direction is situated, as a result of which this lancet bends off towards, and is taken up in, another lancet holder. This means that the funnel of lancets through which the pile warp yarns have to pass has an opening which is essentially equal to twice the centre-to-centre distance between two successive lancets. Pile warp yarns which run in the centre of this shed will still end up in a funnel of lancets with an opening of only once the centre-to-centre distance between two successive lancets and the above-described problem still occurs.

It is an object of the invention to provide a weaving machine for weaving pile fabrics, and a set of spacers for a weaving machine for weaving pile fabrics which does not have the abovementioned drawbacks, and wherein the pile warp yarns have more space during their movement in the shed-forming zone towards the fabric line in the warp direction at their entry point in the array of lancets, so that they are hindered to a lesser degree by this array of lancets.

This object of the invention is achieved by providing a weaving machine for weaving pile fabrics consisting of weft yarns, ground warp yarns and pile warp yarns, comprising:

- a bottom and/or top cutting bar which is provided in order to guide at least one pile fabric;
- at least one set of at least two spacers extending next to one another which extend between the pile warp yarns and which are provided in order to either achieve a uniform pile height between two formed pile fabrics, or to determine the pile loop height in one or more pile fabrics which comprise looped pile, wherein these two spacers extending next to one another, at their ends near the one or more cutting bars, have projections which coincide on projection in the weft direction onto a plane at right angles to the weft direction;
- a yarn stock of pile warp yarns;
- one or more shed-forming devices which drive healds through which ground and/or pile warp yarns extend in order to position these warp yarns with regard to the weft yarns;
- a supply zone of pile warp yarns which extends between said yarn stock and said healds;
- at least two holders to clamp the spacers into, and which are arranged one above the other outside said supply zone;
- a shed-forming zone within which the pile warp yarns can move, and which is delimited by said holders of the spacers and said shed-forming devices, wherein the spacers are provided and arranged in such a manner that the projections in the weft direction onto a plane at right angles to the weft direction of the path of at least one pile warp yarn starting from the holders of the spacers up to said cutting bars, and of said two spacers extending next to one another, viewed in the direction of travel of the pile warp yarn, successively relate to one another as follows:

- in a first section, said projection of the path of the pile warp yarn does not overlap any of the projections of said two spacers;
- subsequently, said projection of the path of the pile warp yarn overlaps the projection of one of said projections of said two spacers separately, and
- finally, said projection of the path of the pile warp yarn overlaps the projections of both said spacers simultaneously.

By providing a weaving machine having an embodiment and configuration of spacers according to the invention, a zone of a pile warp yarn, and more particularly of a pile warp yarn having a knot, will encounter a first rising edge of a spacer during its movement in the warp direction at a first point in time (this occurs possibly together with the adjacent pile warp yarns) before encountering a second rising edge of another spacer at a later point in time. At the first point in time, said zone of the pile warp yarn changes from a state wherein it extends next to other pile warp yarns without being hindered by the presence of spacers over a distance which, in the weft direction, is at least double that of the centre-to-centre distance between the spacers in the weft direction (usually, the centre-to-centre distance between the spacers in the weft direction corresponds to the distance between two reed dents of the weaving reed).

However, in prior-art devices, such as for example mentioned in EP 1 568 809 which has already been cited, the same zones of pile warp yarns change from a state wherein they extend next to one another without being hindered by the presence of spacers to a state wherein they are hindered by the presence of spacers over a distance in the weft direction which is equal to the centre-to-centre distance between the spacers (viewed in the weft direction). The hindrance caused by said constriction (funnel shape) is thus clearly greater in the prior art. According to the invention, the same zone of the pile warp yarn does not experience the same spatial restriction as it experiences at the first point in time in the prior art until a second point In time, namely at the point in time when a pile warp yarn is surrounded by spacers which are next to one another (in other words at that point in time when the projection in the weft direction onto a plane at right angles to the weft direction of the pile warp yarn and the spacers which are next to one another overlap), with an intermediate distance which is equal to the centre-to-centre distance between the spacers. The impact on the pile warp yarn will only occur at that moment as a result of the collision with the edge of the spacer, the projection of the edge of which in the weft direction onto a plane at right angles to the weft direction is furthest from the holders of the spacers. This offers the additional advantage that with the weaving machine according to the invention, the shock at the transition from a zone with more space to a zone with less space is spread over two points in time, as a result of which the local impact on the yarn can be halved, thus significantly reducing the consequences of this impact, such as rupture of the pile warp yarn, damage to the pile warp yarn and wear of the spacers.

In a preferred embodiment of a weaving machine according to the invention, the spacers are provided and arranged in such a manner that the projection in the weft direction onto a plane at right angles to the weft direction of the path of each of the pile warp yarns starting from the holders of the spacers up to said cutting bars, together with the projections in the weft direction onto a plane at right angles to the weft direction of said two spacers extending next to one another, viewed in the direction of travel of the pile warp yarns, successively relate to one another as follows:

in a first section, said projections of the paths of the pile warp yarns do not overlap any of the projections of said two spacers;

subsequently, said projections of the paths of the pile warp yarns overlap the projection of one of said projections of said two spacers separately, and finally, said projections of the paths of the pile warp yarns overlap the projections of both said spacers simultaneously.

On the one hand, the invention can be used for a weaving machine according to the invention with spacers, wherein each spacer is securely held in one holder element.

More preferably, the spacers which are next to one another are provided and arranged as follows, with a repeat pattern over 4 spacers:

a first spacer which is taken up in a first holder element and which, viewed in the direction of travel of the pile warp yarn, bends off over a first distance towards the central zone of the shed;

a second spacer which is taken up in the same first holder element and which, viewed in the direction of travel of the pile warp yarn, bends off over a second distance, which differs from the first distance, towards the central zone of the shed;

a third spacer which is taken up in the second holder element and which, viewed in the direction of travel of the pile warp yarn, bends off over a third distance, which differs from the second distance, towards the central zone of the shed;

a fourth spacer which is taken up in the second holder element and which, viewed in the direction of travel of the pile warp yarn, bends off over a fourth distance, which differs from the third and the first distance, towards the central zone of the shed.

Still more preferably, the third distance is equal to the first distance, and the fourth distance is equal to the second distance.

On the other hand, the invention can be used for a weaving machine for weaving pile fabrics with spacers which are each held in two holders which are arranged one above the other.

Preferably, the spacer comprises a continuous section and an uptake fork which, viewed in the direction of travel of the pile warp yarn, is situated upstream of this continuous section.

In this case, the projection in the weft direction onto a plane at right angles to the weft direction of the uptake fork of a first spacer and the projection of the second spacer next thereto produced in the same manner can only overlap in the shed-forming zone at the position of the continuous section of this adjacent second spacer, with the uptake fork of the first spacer extending further away from the holders than the uptake fork of the adjacent second spacer.

On the one hand, the projection in the weft direction onto a plane at right angles to the weft direction of the uptake fork of a first spacer and the projection of a spacer next thereto produced in the same manner can only overlap in the shed-forming zone at the continuous sections of the spacers.

On the other hand, the continuous sections of spacers which are next to one another can be provided and arranged in such a manner that they are uniform and central.

Finally, the continuous sections of two spacers which are next to one another can be provided and arranged in such a manner that the continuous section of one spacer extends above the continuous section of the other spacer next thereto.

In an advantageous embodiment of a weaving machine according to the invention, the weaving machine is a face-to-face weaving machine for weaving cut pile with or without looped pile which Is provided with a top and a bottom cutting bar between which the spacers extend.

With a face-to-face weaving machine according to the invention, and if the continuous sections of two spacers which are next to one another are provided and arranged in such a manner that the continuous section of one spacer extends above the continuous section of the other spacer next thereto, said continuous sections run centrally between the bottom and the top cutting bar.

The face-to-face weaving machine is preferably provided for weaving fabrics with looped pile and is provided with a bottom cutting bar on which the spacers extend.

The object of the invention is furthermore achieved by providing a set of at least two spacers provided to be mounted next to one another in a weaving machine for weaving pile fabrics, consisting of weft yarns, ground warp yarns and pile warp yarns, the weaving machine comprising a bottom and/or top cutting bar which is provided in order to guide at least one pile fabric;

a yarn stock of pile warp yarns;

one or more shed-forming devices which drive healds through which ground and/or pile warp yarns extend in order to position these warp yarns with regard to the weft yarns;

a supply zone of pile warp yarns which extends between said yarn stock and said healds;

a shed-forming zone within which the pile warp yarns can move, and which is delimited by said holders of the spacers and said shed-forming devices; and wherein the spacers are provided in order to either achieve a uniform pile height between two formed pile fabrics, or to determine the pile loop height in one or more pile fabrics which comprise looped pile, and are provided in order to be clamped into at least two holders which are arranged one above the other outside said supply zone;

wherein the spacers are provided in such a manner that when they are mounted in the weaving machine, upon projection in the weft direction onto a plane at right angles to the weft direction of the path of at least one pile warp yarn starting from the holders of the spacers up to said cutting bars, together with the projections in the weft direction onto a plane at right angles to the weft direction of the spacer, viewed in the direction of travel of the pile warp yarn:

have a first section, the projection of which does not overlap the projection of the pile warp yarn;

have a second section, the projection of one of the spacers of which overlaps the projection of the path of the pile warp yarn and the projection of the other adjacent spacer does not overlap the projection of the path of the pile warp yarn;

have a third section, the projection of which overlaps the projection of the path of the pile warp yarn.

The set according to the invention is preferably provided to be mounted in a weaving machine according to the invention as described above.

The present invention will now be explained in more detail by means of the following detailed description of a weaving machine and a set of spacers according to the invention. The aim of this description is solely to give an illustrative example and to indicate further advantages and features of the present invention, and can thus not be interpreted as a limitation of the area of application of the invention or of the patent rights claimed in the claims.

Reference numerals are used in this detailed description to refer to the attached drawings, wherein

BRIEF DESCRIPTION OF THE DRAWINGS

FIG. 4 shows a schematic projection in the weft direction of part of a first embodiment of a face-to-face weaving machine according to the invention, wherein part of one set of 4 spacers according to the invention extending next to one another are mounted in two holders arranged one above the other, FIG. 5*a* shows part of the first spacer from the set of spacers as illustrated in FIG. 4, FIG. 5*b* shows part of the second spacer from the set of spacers as illustrated in FIG. 4, which second spacer is situated next to the first spacer, FIG. 5*c* shows part of the third spacer from the set of spacers as illustrated in FIG. 4, which third spacer is situated next to the second spacer, FIG. 5*d* shows part of the fourth spacer from the set of spacers as illustrated in FIG. 4, which fourth spacer is situated next to the third spacer, FIG. 6*a* shows a projection in the weft direction along line I-I as indicated in FIG. 4, FIG. 6*b* shows a projection in the weft direction along line II-II as indicated in FIG. 4, FIG. 6*c* shows a projection in the weft direction along line III-III as indicated in FIG. 4, FIG. 7 shows a schematic projection in the weft direction of part of a second embodiment of a face-to-face weaving machine according to the invention, wherein part of one set of 2 spacers according to the invention and extending next to one another is shown, each of which 2 spacers being mounted in two holders which are arranged one above the other, FIG. 8*a* shows part of the first spacer from the set of spacers as illustrated in FIG. 7, FIG. 8*b* shows part of the second spacer from the set of spacers as illustrated in FIG. 7, which second spacer is situated next to the first spacer, FIG. 9*a* shows a projection in the weft direction along line I-I as indicated in FIG. 7, FIG. 9*b* shows a projection in the weft direction along line II-II as indicated in FIG. 7, FIG. 9*c* shows a projection in the weft direction along line III-III as indicated in FIG. 4.

DETAILED DESCRIPTION OF THE PREFERRED EMBODIMENTS

Figure 1:
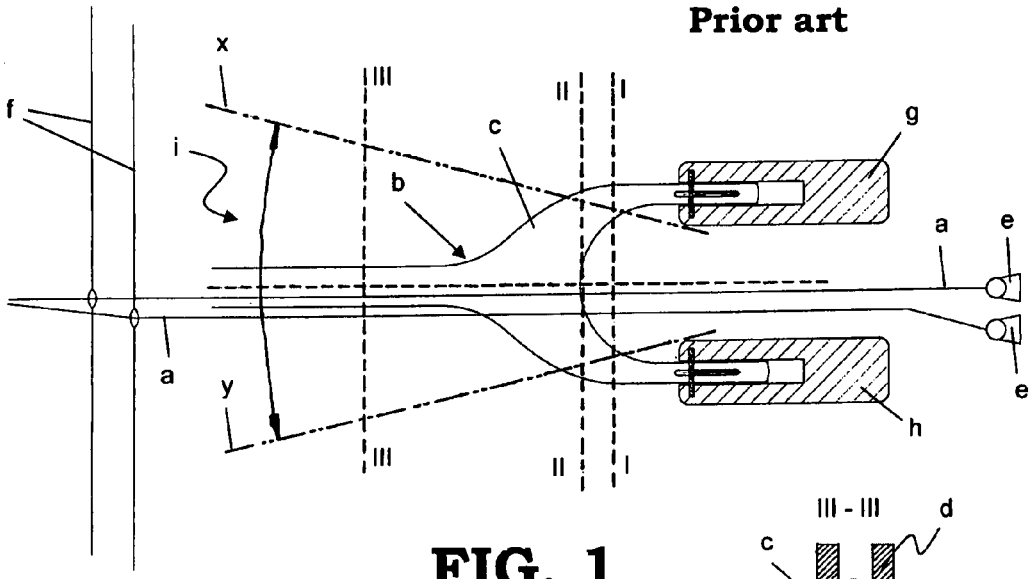
FIG. 1 shows a schematic projection in the weft direction of part of a prior-art face-to-face weaving machine, wherein part of one set of two prior-art spacers is shown, which prior-art spacers extend next to one another and are mounted in two holders which are arranged one above the other.

The prior-art face-to-face weaving machine as described in EP 1 568 809 cited above, part of which is shown in FIG. 1, is provided for weaving pile fabrics (not shown in the figure), consisting of weft yarns, ground warp yarns and pile warp yarns (a). The weaving machine in this case comprises:

- a bottom and/or top cutting bar (not shown in the figures) which is provided in order to guide at least one pile fabric;
- several sets (b) of at least two spacers (c, d) extending next to one another, also referred to as lancets, which extend between the pile warp yarns (a) and which are provided in order to either achieve a uniform pile height between two formed pile fabrics, or to determine the pile loop height in one or more pile fabrics which comprise looped pile, wherein these two lancets (c, d) extending next to one another, at their ends near the one or more cutting bars, have projections which coincide on projection in the weft direction onto a plane at right angles to the weft direction;
- a yarn stock (e) of pile warp yarns (a);
- one or more shed-forming devices which drive healds (f) through which ground and/or pile warp yarns (a) extend in order to position these warp yarns with regard to the weft yarns;
- a supply zone of pile warp yarns (a) which extends between said yarn stock (e) and said healds (f);
- a double holder (g, h) to clamp the lancets (c, d) into, the holders (g, h) being arranged one above the other outside said supply zone, one holder (g) being arranged above said supply zone and the other holder (h) being arranged below said supply zone;
- a shed-forming zone (i) within which the pile warp yarns (a) can move, and which is delimited by said holders (g, h) of the spacers (c, d) and said shed-forming devices, more particularly delimited by the boundary lines (x and y).

Figure 3C:
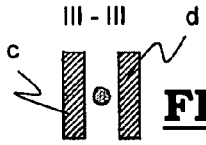
FIG. 3*c* shows a projection in the weft direction along line III-III as indicated in FIG. 1.
Figure 2A:
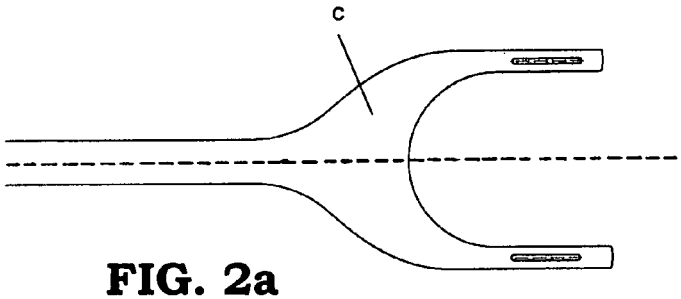
FIG. 2*a* shows part of one of the spacers from the set of spacers as illustrated in FIG. 1.
Figure 3B:
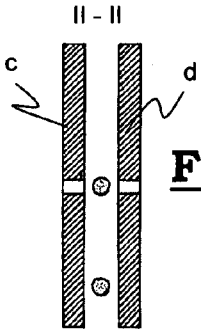
FIG. 3*b* shows a projection in the weft direction along line II-II as indicated in FIG. 1.
Figure 2B:
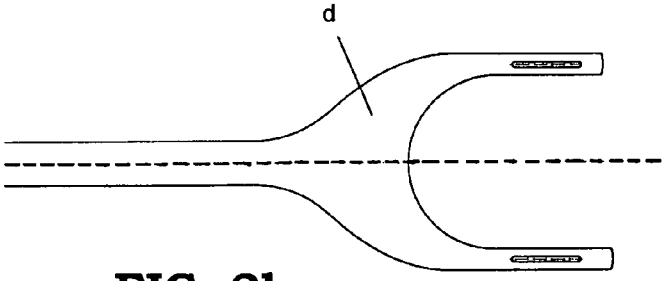
FIG. 2*b* shows part of the second spacer from the set of spacers as illustrated in FIG. 1, which second spacer is situated next to the first spacer.
Figure 3A:
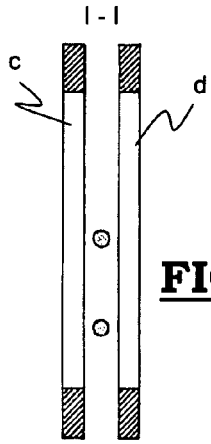
FIG. 3*a* shows a projection in the weft direction along line I-I as indicated in FIG. 1.

As can be seen in prior art FIG. 2, the shape of the lancets (c, d) from the set (b) is identical. As has already been described above, this results in the various ground and pile warp yarns (a), during their movement towards the fabric line, being pulled between the lancets (c, d) which are next to one another (as can be seen in the prior art figures), and therefore the pile warp yarns (a) move from a zone wherein, upon projection in the weft direction onto a plane at right angles to the weft direction, the projections of a pile warp yarn (a) do not overlap the projections of the lancets (c, d) (see FIG. 3*a*) to a zone wherein, upon projection in the weft direction onto a plane at right angles to the weft direction, the projection of a pile warp yarn (a) does overlap with both projections of the lancets (c, d) (see FIGS. 3*b* and 3*c*), which may, in the situation which has already been described above, result in additional load and friction on the pile warp yarns (a), especially with pile warp yarns (a) with knots, leading to increased wear of the spacers (c, d), as a result of which the edges of the latter will become sharper, in turn leading to more damage to the pile warp yarns (a).

A weaving machine according to the invention, part of which is schematically shown in FIGS. 1, 4, 7 and 10-12, is provided for weaving pile fabrics (not illustrated in the figures) consisting of weft yarns, ground warp yarns and pile warp yarns (18, 18', 18", 18'"), and comprises:

- a bottom and/or top cutting bar (not shown in the figures) which is provided in order to guide at least one pile fabric;
- at least one set (100) of at least two spacers (1-4, 11, 12, 21, 22, 31, 32, 41 and 42) extending next to one another and which extend between the pile warp yarns (18, 18', 18", 18'") and which are provided in order to either achieve a uniform pile height between two formed pile fabrics, or to determine the pile loop height in one or more pile fabrics which comprise looped pile, wherein these two spacers (1-4, 11, 12, 21, 22, 31, 32, 41 and 42) extending next to one another, at their ends near the one or more cutting bars, have projections which coincide on projection in the weft direction onto a plane at right angles to the weft direction;
- a yarn stock (20) of pile warp yarns (18, 18', 18", 18'");
- one or more shed-forming devices which drive healds (19) through which ground and/or pile warp yarns (18, 18', 18", 18'") extend in order to position these warp yarns with regard to the weft yarns;
- a supply zone of pile warp yarns (18, 18', 18", 18'") which extends between said yarn stock (20) and said healds (19);
- at least two holders (7, 8) to clamp the spacers (1-4, 11, 12, 21, 22, 31, 32, 41 and 42) into, and which are arranged one above the other outside said supply zone;
- a shed-forming zone (9) within which the pile warp yarns (18, 18', 18", 18'") can move, and which is delimited by said holders (7, 8) of the spacers (1-4, 11, 12, 21, 22, 31, 32, 41 and 42) and said shed-forming devices, more particularly delimited by the two boundary lines (15 and 16).

The spacers (1-4, 11, 12, 21, 22, 31, 32, 41 and 42) are in this case provided and arranged in such a manner that the projection in the weft direction onto a plane at right angles to the weft direction of the path of at least one pile warp yarn (18, 18', 18", 18'") starting from the holders (7, 8) of the spacers (1-4, 11, 12, 21, 22, 31, 32, 41 and 42) up to said cutting bars, together with the projections in the weft direction onto a plane at right angles to the weft direction of said two spacers (1-4, 11, 12, 21, 22, 31, 32, 41 and 42) extending next to one another, viewed in the direction of travel of the pile warp yarn (18, 18', 18", 18'"), successively relate to one another as follows:

- in a first section, said projection of the path of the pile warp yarn (18, 18', 18", 18'") does not overlap any of the projections of said two spacers (1-4, 11, 12, 21, 22, 31, 32, 41 and 42);
- subsequently, said projection of the path of the pile warp yarn (18, 18', 18", 18'") overlaps the projection of one of said projections of said two spacers (1-4, 11, 12, 21, 22, 31, 32, 41 and 42) separately, and
- finally, said projection of the path of the pile warp yarn (18, 18', 18", 18'") overlaps the projections of both said spacers (1-4, 11, 12, 21, 22, 31, 32, 41 and 42) simultaneously.

It should be noted that the term "path" of a pile warp yarn (18, 18') is understood to mean both the course of a pile warp yarn (18, 18', 18", 18'") between the yarn stock (20, 20') and the heald eye (19*a*, 19*a*') in a stationary position, and the movement which a point of a pile warp yarn (e.g. a knot of a pile warp yarn) travels between the yarn stock and the heald eye. This latter interpretation of the term "path" is important since the pile warp yarns (18, 18', 18", 18'") also move up and down in the shed-forming zone during this movement of the pile warp yarn between the yarn stock and the heald eye.

Preferably, the spacers (1-4, 11, 12, 21, 22, 31, 32, 41 and 42) can be provided and arranged in such a manner that the projection in the weft direction onto a plane at right angles to the weft direction of the path of each of the pile warp yarns (18, 18', 18", 18'") starting from the holders (7, 8) of the spacers (1-4, 11, 12, 21, 22, 31, 32, 41 and 42) up to said cutting bars, together with the projections in the weft direction onto a plane at right angles to the weft direction of said two spacers (1-4, 11, 12, 21, 22, 31, 32, 41 and 42) extending next to one another, viewed in the direction of travel of the pile warp yarns (18, 18', 18", 18'"), successively relate to one another as follows:

- in a first section, said projections of the paths of the pile warp yarns (18, 18', 18", 18'") do not overlap with any of the projections of said two spacers (1-4, 11, 12, 21, 22, 31, 32, 41 and 42),
- subsequently, said projections of the paths of the pile warp yarns (18, 18', 18", 18'") overlap with the projection of one of said projections of said two spacers (1-4, 11, 12, 21, 22, 31, 32, 41 and 42) separately, and
- finally, said projections of the paths of the pile warp yarns (18, 18', 18", 18'") overlap with the projections of both said spacers (1-4, 11, 12, 21, 22, 31 32, 41 and 42) simultaneously.

On the one hand, the invention can be used for spacers (1-4) each of which is only held in one holder (7, 8).

In an embodiment such as that shown in FIG. 4, a set of spacers consists of 4 spacers (1-4) which, as shown in FIGS. 5*a* to 5*d*, have a different profile upon projection in the weft direction onto a plane at right angles to the weft direction. Each of the spacers is thus taken up in only one holder (7, 8), while the accommodation of the various spacers (1-4) is spread over the various holders (7, 8).

The shed-forming zone (9) starts at the spacers (1-4) and is delimited by the boundary lines (15, 16).

The spacers (1-4) which are next to one another are preferably provided and arranged as follows with a repeat pattern over 4 spacers (1-4):

- a first spacer (1) which is taken up in a first holder (7) and which, viewed in the direction of travel of the pile warp yarn (18, 18'), bends off over a first distance towards the central zone of the shed;
- a second spacer (2) which is taken up in the same first holder (7) and which, viewed in the direction of travel of the pile warp yarn (18; 18'), bends off over a second distance, which differs from the first distance, towards the central zone of the shed;
- a third spacer (3) which is taken up in the second holder (8) and which, viewed in the direction of travel of the pile warp yarn (18, 18'), bends off over a third distance, which differs from the second distance, towards the central zone of the shed;
- a fourth spacer (4) which is taken up in the second holder (8) and which, viewed in the direction of travel of the pile warp yarn (18, 18'), bends off over a fourth distance, which differs from the third and the first distance, towards the central zone of the shed.

In this embodiment, a first pile warp yarn (18) extends between two spacers which are next to one another, i.e. spacers (2 and 4), starting from a yarn stock (20) (which is symbolically shown in the figures as a spool which is, in practice, usually provided in a weaving rack), and moves along between the two holders (7 and 8) arranged one above the other and then continues from the front of the holder (7,8) in a straight line to the heald eye (19*a*) in the heald (19) which is driven by the shed-forming device. On its path through the shed-forming zone (9), the projection in the weft direction onto a plane at right angles to the weft direction of the path of the pile warp yarn (18), starting from the holder (8) of the spacers (2 and 4) up to the cutting bars, and the same projections of the two spacers (2 and 4) extending next to one another, viewed in the direction of travel of the pile warp yarn (18), successively relate to one another as follows:

- as can be seen in FIG. 6*a*, in a first section, said projection of the pile warp yarn (18) does not overlap any of the projections of said two spacers (2 and 4);
- as can be seen in FIG. 6*b*, said projection of the pile warp yarn (18) overlaps the projection of said projection of spacers (4), and
- as can be seen in FIG. 6*c*, said projection of the pile warp yarn (18) overlaps the projections of both said spacers (2 and 4).

In the cross section of FIG. 6*a*, the first spacer (2), the projection of which in the weft direction onto a plane at right angles to the weft direction overlaps the projection in the weft direction onto a plane at right angles to the weft direction of the pile warp yarn (18), is situated at 4 times the centre-to-centre distance to the next spacer, namely the one with the same profile.

A second pile warp yarn (18'), which extends between two other spacers which are next to one another, i.e. spacers (3, 4), extends from a yarn stock (20'), runs between the two spacers (7, 8) arranged one above the other and continues from the front of the holders (7, 8) in a straight line to the heald eye (19*a*') in the heald. (19') which is driven by the shed-forming device. On its path through the shed-forming zone (9), the projections in the weft direction onto a plane at right angles to the weft direction of the path of the pile warp yarn (18'), starting from the holder (7) of the spacers (3, 4) up to the cutting bars, and of the two spacers (3, 4) extending next to one another, viewed in the direction of travel of the pile warp yarn (18'), successively relate to one another as follows:

- as can be seen in FIG. 6*a*, in a first section, said projection of the path of the pile warp yarn (18') overlaps the projection of the spacer (3); and
- as can be seen in FIG. 6*b*, said projection of the path of the pile warp yarn (18') overlaps the projection of said projection of spacer (4).

In a further section, just before the cutting bars where the fabrics are formed by beating up the introduced weft yarns against the fabric line using the weaving reed, the projection of the path of the pile warp yarn (18') will overlap the projection of both said spacers (3, 4) when the pile warp yarn (18') has moved, in the case of face-to-face weaving, from the top fabric to the bottom fabric, for example when it has been tied up so as to form pile over a weft yarn introduced into the top fabric, after which it will be tied up so as to form pile over a weft yarn in the bottom fabric. In a further preferred embodiment, as is shown in FIG. 4, the third distance is equal to the first distance, and the fourth distance is equal to the second distance. On the other hand, the invention can be used for spacers (11, 12, 21, 22, 31, 32, 41 and 42), each of which is held in two holders (7, 8) which are arranged one above the other.

In an embodiment such as that shown in FIG. 7, the spacers (11, 12) are taken up in both holders (7, 8) and have, as is shown in FIGS. 8*a* and 8*b*, a different profile upon projection in the weft direction onto a plane at right angles to the weft direction.

The shed-forming zone (9) starts at the holders (7, 8) and is delimited by the boundary lines (15, 16).

In this embodiment, a first pile warp yarn (18") extends between the two spacers (11, 12) which are next to one another. Pile warp yarn (18") starts from a yarn stock (20), runs between the two holders (7, 8) arranged one above the other and continues from the front of the holders (7,8) in a straight line to the heald eye (19*a*) in the heald (19) which is driven by the shed-forming device. On its path through the shed-forming zone (9), the projections in the weft direction onto a plane at right angles to the weft direction of the path of the pile warp yarn (18"), starting from the holder (8) of the spacers (11, 12) up to the cutting bars, and of the two spacers (11, 12) extending next to one another, viewed in the direction of travel of the pile warp yarn (18"), successively relate to one another as follows:

- as can be seen in FIG. 9*a*, in a first section, said projection of the pile warp yarn (18") overlaps the projection of the spacer (12);
- as can be seen in FIG. 9*b*, said projection of the pile warp yarn (18") overlaps the projection of said projection of spacer (12);
- as can be seen in FIG. 9*c*, said projection of the pile warp yarn (18") overlaps the projections of both spacers (11, 12).

In the cross section shown in FIG. 9*a*, the first spacer (12), the projection of which in the weft direction onto a plane at right angles to the weft direction overlaps the projection in the weft direction onto a plane at right angles to the weft direction of the pile warp yarn (18"), is situated at 2 times the centre-to-centre distance to the next spacer, namely the one with the same profile.

A second pile warp yarn (18'''), which extends between the two spacers (11, 12) which are next to one another, extends from a yarn stock (20), runs between the two spacers (7, 8) arranged one above the other and continues from the front of the holders (7, 8) in a straight line to the heald eye (19*a*'''') in the heald (19''') which is driven by the shed-forming device. On its path through the shed-forming zone (9), the projections in the weft direction onto a plane at right angles to the weft direction of the path of the pile warp yarn (18'''), starting from the holder (7) of the spacers (11, 12) up to the cutting bars, and of the two spacers (11, 12) extending next to one another, viewed in the direction of travel of the pile warp yarn (18'''), successively relate to one another as follows:

- as can be seen in FIG. 9*a*, in a first section, said projection of the pile warp yarn (18''') overlaps the projection of the spacer (12); and
- as can be seen in FIG. 9*b*, said projection of the pile warp yarn (18''') overlaps the projection of said projection of spacer (11).

In a further section, just before the cutting bars where the fabrics are formed by beating up the introduced weft yarns against the fabric line using the weaving reed, the projection of the path of the pile warp yarn (18''') will overlap the projection of both said spacers when, for example, the heald eye (19*a*'''') is in a position above the spacers (11, 12).

In the embodiments as shown in FIGS. 7 and 10 to 12, the spacers (11, 12, 21, 22, 31, 32, 41 and 42) comprise an uptake fork (50, 60, 70, 80, 90, 100), which is the part of the spacers (11, 12, 21, 22, 31, 32, 41 and 42) from the continuous part (51, 61, 71, 81, 91, 101) to the holders (7, 8). Compared to the continuous part (51, 61, 71, 81, 91, 101), the uptake fork (50, 60, 70, 80, 90, 100) has a greater height and forks into two legs, each of which is taken up in one of the holders (7, 8).

The uptake fork (50, 55, 70, 90) of the first spacer (11, 21, 31, 41) in this case extends further away from the holders (7, 8) than the uptake fork (60, 65, 80, 100) of the second adjacent spacer (12, 22, 32, 42).

In the embodiment as shown in FIG. 7, the projections in the weft direction onto a plane at right angles to the weft direction of the uptake fork (50, 55, 70, 90) of a first spacer (11, 21, 31, 41) and the projections of the adjacent spacers (12, 22, 32, 42) produced in the same manner can only overlap within the shed-forming zone at the position of the continuous sections (51, 61, 56, 66, 71, 81, 91, 101) of the spacers (11, 12, 21, 22, 31, 32, 41, 42).

The advantage of these embodiments is that the projections in the weft direction onto a plane at right angles to the weft direction of pile warp yarns (18''') which extend outside the central zone of the shed in the shed formation (outside the central zone is the zone which, in FIG. 7, is outside the continuous sections (51, 61) of the spacers (11, 12)), do not overlap the projections in the weft direction onto a plane at right angles to the weft direction of two spacers (11, 12) which are a centre-to-centre distance apart anywhere. In a first section of the path of these pile warp yarns (18''') the projection in the weft direction onto a plane at right angles to the weft direction of these pile warp yarns (18''') overlaps the projection of the first spacer (11), and in a second section, the projection in the weft direction onto a plane at right angles to the weft direction of these pile warp yarns (18''') overlaps the projection of the second spacer (12), the overlap of the projection of the first spacer (11) already having finished. This means that the impact of collisions of the pile warp yarn in the warp direction upon entering the array of spacers remains limited.

The impact to which the pile warp yarn (18''') is subjected when a collision occurs with an adjacent spacer (11 and/or 12) is limited due to the presence of one spacer (11 or 12) per double centre-to-centre distance between the spacers (11, 12), which reduces the risk of pile warp yarn rupture and limits wear of the spacers.

Figure 10:
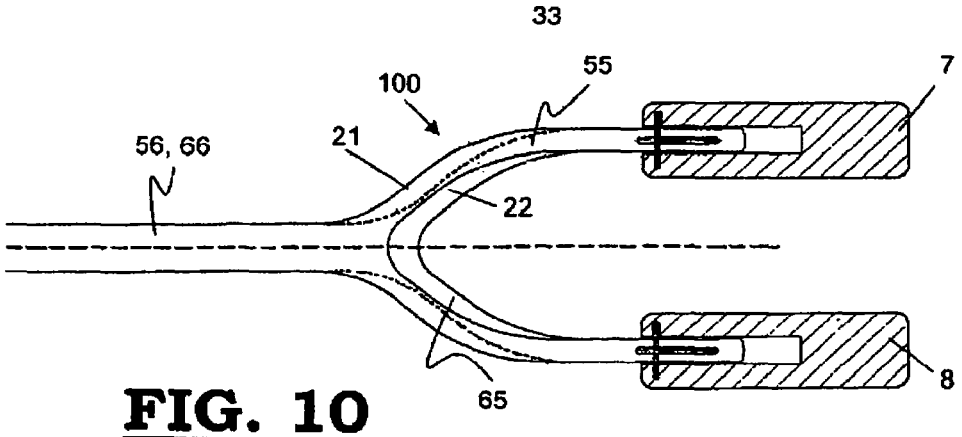
FIG. 10 shows part of a third embodiment of a set of 2 spacers according to the invention and extending next to one another, each of which 2 spacers being mounted in two holders which are arranged one above the other, the continuous part extending uniformly and centrally between the bottom and the top cutting bar of the face-to-face weaving machine.

In the embodiment shown in FIG. 10, the projections in the weft direction onto a plane at right angles to the weft direction of the uptake fork (56) of a first spacer (21) and the uptake fork (66) of the second spacer (12) overlap within the shed-forming zone (9) at the position of the continuous parts (56, 66) of the spacers (21, 22). However, upon projection in the weft direction onto a plane at right angles to the weft direction, a partial overlap of the uptake forks (55, 65) also occurs. As a result, in this embodiment, the projection in the weft direction onto a plane at right angles to the weft direction first overlaps the projection of the path of each of the pile warp yarns (not shown in this figure) with the projection of the spacer (22), and subsequently additionally overlaps with the projection of the spacer (21). However, the impact when such pile warp yarns contact the spacers (21, 22) will be limited as the impact is spread over time in this embodiment as well. This is due to the fact that the projection in the weft direction onto a plane at right angles to the weft direction of the parts of the pile warp yarn which give rise to considerable impact upon starting contact with the spacers (21, 22) overlaps the projections of the adjacent spacers (21, 22) at a different point in time, so that when the parts of the pile warp yarn collide with the spacers (21, 22) this will occur at a different point in time. The difference in impact is more significant if there is a knot in the pile warp yarn, for example when the pile warp yarn of two spools have been connected to one another or when a ruptured pile warp yarn has been repaired.

In this embodiment, the continuous part (56, 66) runs uniformly and centrally up to the point where it emerges from between the bottom and the top cutting bar.

Figure 11:
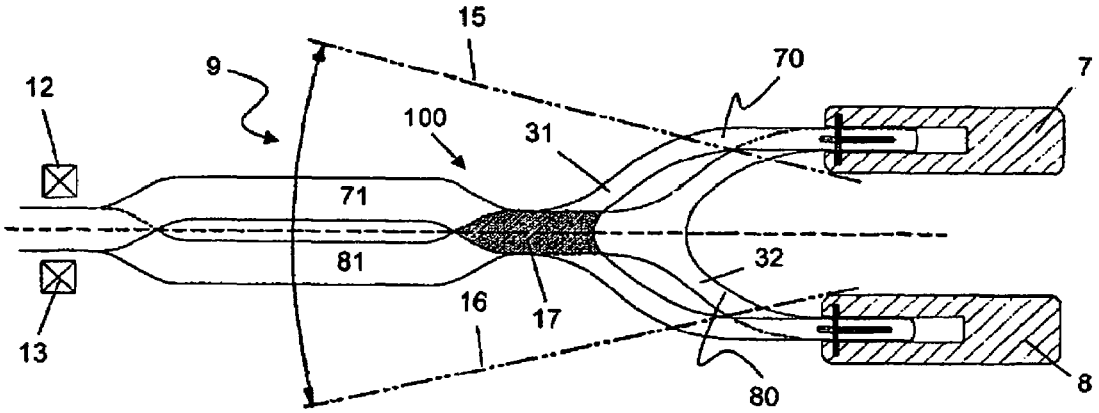
FIGS. 11 and 12 show part of a fourth and a fifth embodiment of a set of 2 spacers according to the invention extending next to one another, each of which 2 spacers being mounted in two holders which are arranged above one another, and the continuous part being split into a continuous part of one spacer which extends above the continuous part of the other spacer which is situated next thereto.
Figure 12:
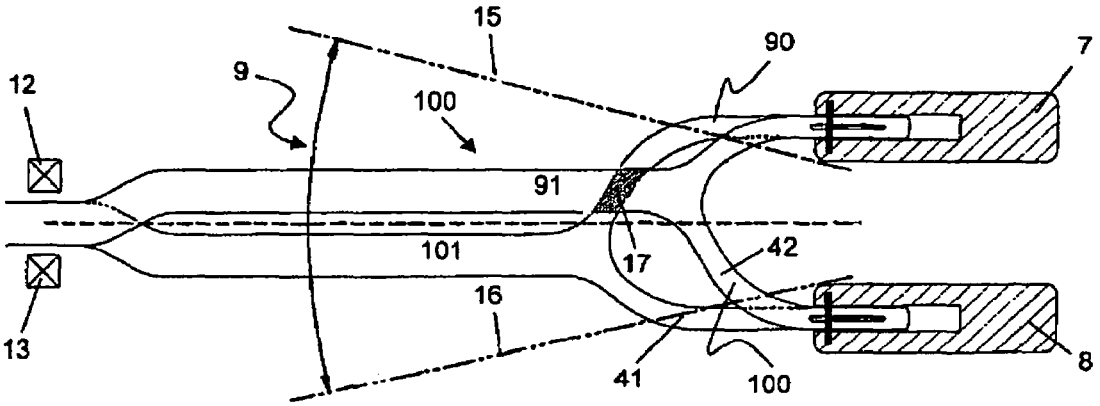

However, as is shown in FIGS. 11 and 12, the continuous part (71, 81 and 91, 101, respectively) of spacers (31, 32 and 41, 42, respectively) which are next to one another can be divided into a continuous part (71 and 91, respectively) of the one spacer (31, 41) which extends above the continuous part (81 and 101, respectively) of the other spacer (32 and 42, respectively) next thereto. In this manner, the zones (17) within which pile warp yarns (not shown in the figures) have to move between two spacers (31, 41 and 32, 42, respectively) which are at a distance from one another which is equal to the centre-to-centre distance between spacers (31, 41 and 32, 42, respectively) which are next to one another are greatly limited. In addition, such a zone always occurs at the end of the spacers (31, 41 and 32, 42, respectively) at the position of the weft-introduction means (12, 13) because there the continuous sections (71, 81 and 91, 101, respectively) meet again. There, situations may again occur wherein pile warp yarns simultaneously contact two spacers (31, 41 and 32, 42, respectively) which are next to one another. However, the closer this contact with the spacers (31, 41 and 32, 42, respectively) is located to the fabric line, the lower the build-up of tension in the pile warp yarn is, due to the more limited friction along these shorter distances over which the pile warp yarns are in contact with the spacers.

In FIG. 11, both continuous sections (71, 81) of the spacers (31, 32) already start at the Junction with the uptake forks (70, 80) and further away from the holders (7, 8) fork into continuous sections (71, 81) which are arranged one above the other resulting in the abovementioned advantages.

If, as in FIG. 12, both continuous sections (91, 101) are provided to be arranged one above the other in the vertical direction from the junction with the uptake forks (90, 100) onwards, the zone wherein the projection in the weft direction onto a plane at right angles to the weft direction of pile warp yarns (not shown in the figures) overlaps the projection of the spacers (41, 42) which are at a distance from one another which is equal to the centre-to-centre distance of the spacers (41, 42) and between which these pile warp yarns extend is reduced further. This reduces the tension which is built up in the pile warp yarns and reduces the risk of rupture of pile warp yarns and wear of the spacers (41, 42).

The weaving machine may be a single-piece or a face-to-face weaving machine. The face-to-face weaving machine may in this case be provided for weaving pile with or without looped pile, wherein a top and a bottom cutting bar are provided between which the spacers (1-4, 11, 12, 21, 22, 31, 32, 41 and 42) extend, and wherein the top and the bottom cutting bar determine the (sum of the) pile heights of the fabrics or the loop height of the pile loops in the fabrics.

In this case, a single-piece weaving machine is usually provided with one cutting bar, i.e. a bottom cutting bar, on which the spacers (1-4, 11, 12, 21, 22, 31, 32, 41 and 42) extend and wherein the spacers (1-4, 11, 12, 21, 22, 31, 32, 41 and 42) are used to ensure the loop height.

The invention claimed is:

1. Weaving machine for weaving pile fabrics consisting of weft yarns, ground warp yarns and pile warp yarns, comprising:

a bottom and/or top cutting bar which is provided in order to guide at least one pile fabric;

at least one set (100) of at least two spacers(1-4, 11, 12, 21, 22, 31, 32, 41 and 42) extending next to one another which extend between the pile warp yarns (18, 18', 18'', 18''') and which are provided to either achieve a uniform pile height between two formed pile fabrics, or to determine the pile loop height in one or more pile fabrics which comprise looped pile, wherein these two spacers (1-4, 11, 12, 21, 22, 31, 32, 41 and 42) extending next to one another, at their ends near the one or more cutting bars, have projections which coincide on projection in the weft direction onto a plane at right angles to the weft direction;

a yarn stock (20, 20') of pile warp yarns;

one or more shed-forming devices which drive healds through which ground and/or pile warp yarns (18, 18', 18", 18'") extend in order to position these warp yarns with regard to the weft yarns;

a supply zone of pile warp yarns (18, 18', 18", 18'") which extends between said thread stock and said healds;

at least two holders (7, 8) to clamp the spacers (1-4, 11, 12, 21, 22, 31, 32, 41 and 42) into, and which are arranged one above the other outside said supply zone;

a shed-forming zone (9) within which the pile warp yarns (18, 18', 18", 18'") can move, and which is delimited by said holders (7, 8) of the spacers (1-4, 11, 12, 21, 22, 31, 32, 41 and 42) and said shed-forming devices;

wherein the spacers (1-4, 11, 12, 21, 22, 31, 32, 41 and 42) are provided and arranged in such a manner that the projections in the weft direction onto a plane at right angles to the weft direction of the path of at least one pile warp thread (18, 18', 18", 18'") starting from the holders (7, 8) of the spacers (1-4, 11, 12, 21, 22, 31, 32, 41 and 42) up to said cutting bars, and of said two spacers (1-4, 11, 12, 21, 22, 31, 32, 41 and 42) extending next to one another, viewed in the direction of travel of the pile warp yarn (18, 18', 18", 18'"), successively relate to one another as follows:

in a first section, said projection of the path of the pile warp yarn (18, 18', 18", 18'") does not overlap any of the projections of said two spacers (1-4, 11, 12, 21, 22, 31, 32, 41 and 42);

subsequently, said projection of the path of the pile warp yarn (18, 18', 18", 18'") overlaps the projection of one of said projections of said two spacers (1-4, 11, 12, 21, 22, 31, 32, 41 and 42) separately, and finally, said projection of the path of the pile warp yarn (18, 18', 18", 18'") overlaps the projections of both said spacers (1-4, 11, 12, 21, 22, 31, 32, 41 and 42) simultaneously.

2. Weaving machine according to claim 1, wherein the spacers (1-4 , 11, 12, 21, 22, 31, 32, 41 and 42) are provided and arranged in such a manner that the projection in the weft direction onto a plane at right angles to the weft direction of the path of each of the pile warp yarns (18, 18', 18", 18'") starting from the holders (7, 8) of the spacers (1-4, 11, 12, 21, 22, 31, 32, 41 and 42) up to said cutting bars, together with the projections in the weft direction onto a plane at right angles to the weft direction of said two spacers (1-4, 11, 12, 21, 22, 31, 32, 41 and 42) extending next to one another, viewed in the direction of travel of the pile warp yarns (18, 18', 18", 18'"), successively relate to one another as follows:

in a first section, said projection of the pile warp yarns (18, 18', 18", 18'") does not overlap any of the projections of said two spacers (1-4, 11, 12, 21, 22, 31, 32, 41 and 42), subsequently, said projection of each path of a pile warp thread (18, 18', 18", 18'") overlaps the projection of one of said projections of said two spacers (1-4, 11, 12, 21, 22, 31, 32, 41 and 42) separately, and finally, said projection of each path of a pile warp yarn (18, 18', 18", 18'") overlaps the projections of both said spacers (1-4, 11, 12, 21, 22, 31, 32, 41 and 42) simultaneously.

3. Weaving machine according to claim 1 wherein each spacer (1-4) is securely held in one holder element (7, 8).

4. Weaving machine according to claim 3, wherein the spacers (1-4) which are next to one another are provided and arranged as follows, with a repeat pattern over 4 spacers (1-4):

a first spacer (1) which is taken up in a first holder (7) and which, viewed in the direction of travel of the pile warp yarn (18, 18'), bends off over a first distance towards the central zone of the shed;

a second spacer (2) which is taken up in the same first holder (7) and which, viewed in the direction of travel of the pile warp yarn (18; 18') bends off over a second distance, which differs from the first distance, towards the central zone of the shed;

a third spacer (3) which is taken up in the second holder (8) and which, viewed in the direction of travel of the pile warp yarn (18, 18'), bends off over a third distance, which differs from the second distance, towards the central zone of the shed;

a fourth spacer (4) which is taken up in the second holder (8) and which, viewed in the direction of travel of the pile warp yarn (18, 18'), bends off over a fourth distance, which differs from the third and the first distance, towards the central zone of the shed.

5. Weaving machine according to claim 4, wherein the third distance is equal to the first distance, and the fourth distance is equal to the second distance.

6. Weaving machine according to claim 1 wherein each spacer (11, 12, 21, 22, 31, 32, 41 and 42) is held in two holders (7, 8) which are arranged one above the other.

7. Weaving machine according to claim 6, wherein a spacer (11, 12, 21, 22, 31, 32, 41 and 42) comprises a continuous section (51, 61, 56; 66, 71, 81, 91, 101) and an uptake fork (50, 60, 55, 65, 70, 80, 90, 100) which, viewed in the direction of travel of the pile warp yarn (18", 18'"), is situated upstream of this continuous section (51, 61, 56; 66, 71, 81, 91, 101), with the uptake fork (50, 55, 70, 90) of the first spacer (11, 21, 31, 41) extending further away from the holders (7, 8) than the uptake fork (60, 65, 80, 100) of the adjacent second spacer (12, 22, 32, 42).

8. Weaving machine according to claim 7, wherein the projection in the weft direction onto a plane at right angles to the weft direction of the uptake fork (50, 55, 70, 90) of a first spacer (11, 21, 31, 41) and the projection of a spacer (12, 22, 32, 42) next thereto produced in the same manner only overlap in the shed-forming zone at the position of the continuous sections (51, 61, 56, 66, 71, 81, 91, 101) of the spacers (11, 12, 21, 22, 31, 32, 41, 42).

9. Weaving machine according to claim 8, wherein the continuous sections (51, 61, 56, 66) of spacers (11, 12, 21, 22) which are next to one another are provided and arranged in such a manner that they are uniformly and centrally.

10. Weaving machine according to claim 7, wherein the continuous sections (71, 81, 91, 101) of two spacers (31, 32, 41, 42) which are next to one another are provided and arranged in such a manner that the continuous section (71, 91) of one spacer (32, 42) extends above the continuous section (81, 101) of the other spacer (31, 41) next thereto.

11. Weaving machine according to claim 1, wherein the weaving machine is a face-to-face weaving machine for weaving cut pile with or without looped pile which is provided with a top and a bottom cutting bar between which the spacers (1-4, 11, 12, 21, 22, 31, 32, 41 and 42) extend.

12. Weaving machine according to claim 9 wherein said continuous sections (51, 56, 61, 66, 71, 81, 91, 101) run centrally between the bottom and the top cuffing bar.

13. Weaving machine according to claim 11, wherein the weaving machine is a face-to-face weaving machine for weaving fabrics with looped pile which is provided with a bottom cutting bar on which the spacers (1-4, 11, 12, 21, 22, 31, 32, 41 and 42) extend.

14. Set (100) of at least two spacers (1-4, 11, 12, 21, 22, 31, 32, 41 and 42) provided to be mounted next to one another in a weaving machine for weaving pile fabrics, consisting of weft yarns, ground warp yarns and pile warp yarns (18, 18', 18", 18'"), the weaving machine comprising a bottom and/or top cutting bar which is provided in order to guide at least one pile fabric;

a yarn stock of pile warp yarns (18, 18', 18", 18'");

one or more shed-forming devices which drive healds through which ground and/or pile warp yarns (18, 18', 18", 18'") extend in order to position these warp yarns with regard to the weft yarns;

a supply zone of pile warp yarns (18, 18', 18", 18'") which extends between said yarn stock (20, 20', 20", 20'") and said healds (19*a*, 19*a'*, 19*a"*, 19*a'"*);

a shed-forming zone within which the pile warp yarns (18, 18', 18", 18'") can move, and which is delimited by said holders (7, 8) of the spacers (1-4, 11, 12, 21, 22, 31, 32, 41 and 42) and said shed-forming devices;

and wherein the spacers (1-4, 11, 12, 21, 22, 31, 32, 41 and 42) are provided either to achieve a uniform pile height between two formed pile fabrics, or to determine the pile loop height in one or more pile fabrics which comprise looped pile, and are provided in order to be clamped into at least two holders (7, 8) which are arranged one above the other outside said supply zone; wherein the spacers (1-4, 11, 12, 21, 22, 31, 32, 41 and 42) are provided in such a manner that when they are mounted in the weaving machine, upon projection in the weft direction onto a plane at right angles to the weft direction of the path of at least one pile warp thread (18, 18', 18", 18'") starting from the holders (7, 8) of the spacers (1-4, 11, 12, 21, 22, 31, 32, 41 and 42) up to said cutting bars, together with the projections in the weft direction onto a plane at right angles to the weft direction of the spacer (1-4, 11, 12, 21, 22, 31, 32, 41 and 42), viewed in the direction of travel of the pile warp thread (18, 18', 18", 18'"), these spacers:

have a first section, the projection of which does not overlap the projection of the path of the pile warp thread (18, 18', 18", 18'");

have a second section, the projection of one of the spacers (1-4, 11, 12, 21, 22, 31, 32, 41 and 42) of which overlaps the projection of the path of the pile warp thread (18, 18', 18", 18'") and the projection of the other adjacent spacer (1-4, 11, 12, 21, 22, 31, 32, 41 and 42) does not overlap the projection of the pile warp thread (18, 18', 18", 18'");

have a third section, the projection of which overlaps the projection of the path of the pile warp thread (18, 18', 18", 18'").

* * * * *